US008567562B2

(12) United States Patent
Meillet et al.

(10) Patent No.: US 8,567,562 B2
(45) Date of Patent: Oct. 29, 2013

(54) BRAKE ASSEMBLY FOR A SELF-RETRACTING LIFELINE ASSEMBLY

(75) Inventors: Vincent G. Meillet, Cannes la Bocca (FR); Joseph R. Kaiser, Cottage Grove, MN (US)

(73) Assignee: B D Industries, LLC, Red Wing, MN (US)

( * ) Notice: Subject to any disclaimer, the term of this patent is extended or adjusted under 35 U.S.C. 154(b) by 248 days.

(21) Appl. No.: 12/902,425

(22) Filed: Oct. 12, 2010

(65) Prior Publication Data

US 2011/0100755 A1 May 5, 2011

Related U.S. Application Data

(60) Provisional application No. 61/257,228, filed on Nov. 2, 2009.

(51) Int. Cl.
*A62B 1/16* (2006.01)

(52) U.S. Cl.
USPC ..... 182/234; 182/3; 182/70; 182/232

(58) Field of Classification Search
USPC ..... 182/3, 232, 234, 70
See application file for complete search history.

(56) References Cited

U.S. PATENT DOCUMENTS

| | | | |
|---|---|---|---|
| 157,660 | A | 12/1874 | Weston |
| 523,874 | A | 7/1894 | Weston |
| 659,093 | A | 10/1900 | Ockers |
| 1,363,749 | A | 12/1920 | Peterson |
| 1,724,713 | A | 8/1929 | Johnston |
| 1,950,289 | A | 3/1934 | Benson |

(Continued)

FOREIGN PATENT DOCUMENTS

| | | |
|---|---|---|
| CH | 364180 | 9/1958 |
| DE | 177841 | 3/1905 |

(Continued)

OTHER PUBLICATIONS

U.S. Appl. No. 12/751,386, filed Mar. 31, 2010, Meillet et al.

(Continued)

*Primary Examiner* — Alvin Chin Shue
*Assistant Examiner* — Colleen M Chavchavadze
(74) *Attorney, Agent, or Firm* — PLM Group, P.A.

(57) ABSTRACT

A braking system for a self-retracting lifeline assembly is provided. The braking system includes a housing, a ratchet cam and a clutch assembly. The housing includes sidewalls that form, at least in part, a cavity. The sidewalls of the housing terminate in a connecting surface that extends around the cavity. The sidewalls have a plurality of notches spaced along interior surfaces of the sidewalls. Each notch extends from the connecting surface a select distance in the interior surfaces of the sidewalls of the housing. The ratchet cam includes an inner edge that defines a central cam opening. The inner edge of the ratchet cam has a plurality of inward extending teeth. The ratchet cam further has an outer edge. The outer edge has a plurality of outward extending fingers. Each finger terminates in a finger tip. Each finger tip is received in an associated notch in the interior surface of the housing. The clutch assembly is operationally configured to engage at least one tooth of the plurality of inward extending teeth of the ratchet cam in response to a lifeline unwinding from the assembly at a rate greater than a predetermined maximum angular velocity.

21 Claims, 5 Drawing Sheets

(56) References Cited

U.S. PATENT DOCUMENTS

| | | | | |
|---|---|---|---|---|
| 2,268,243 | A | 12/1941 | Curtis | |
| 2,502,896 | A | 4/1950 | Sherbrook et al. | |
| 2,776,815 | A | 1/1957 | Sheard | |
| 2,809,804 | A | 10/1957 | Sheard | |
| 3,081,839 | A | 3/1963 | O'Brien | |
| 3,089,599 | A | 5/1963 | Casella | |
| 3,101,927 | A | 8/1963 | Gray | |
| 3,204,720 | A | 9/1965 | Eitel | |
| 3,879,016 | A | 4/1975 | Kankkunen | |
| 3,946,989 | A | 3/1976 | Tsuda | |
| 3,999,627 | A | 12/1976 | Naka | |
| 4,125,142 | A | 11/1978 | Fohl | |
| 4,177,962 | A | 12/1979 | Hildebrandt | |
| 4,421,209 | A | 12/1983 | Vermette et al. | |
| 4,434,869 | A | 3/1984 | Roop et al. | |
| 4,476,956 | A | 10/1984 | Eger | |
| 4,577,725 | A | 3/1986 | Hunter | |
| 4,589,519 | A | 5/1986 | Hunter | |
| 4,589,523 | A | 5/1986 | Olson et al. | |
| 4,598,792 | A | 7/1986 | Lew et al. | |
| 4,598,793 | A | 7/1986 | Lew et al. | |
| 4,679,656 | A | 7/1987 | Lew et al. | |
| 4,688,657 | A | 8/1987 | Erickson | |
| 4,694,934 | A | 9/1987 | Erickson | |
| 4,702,348 | A | 10/1987 | Lew et al. | |
| 4,737,065 | A | 4/1988 | Ju | |
| 4,793,436 | A | 12/1988 | Lew et al. | |
| 4,830,340 | A | 5/1989 | Knitig | |
| 4,877,110 | A | 10/1989 | Wolner | |
| 5,070,978 | A | 12/1991 | Pires | |
| 5,186,289 | A | 2/1993 | Wolner et al. | |
| 5,287,950 | A | 2/1994 | Feathers et al. | |
| 5,305,852 | A | 4/1994 | Klokseth | |
| 5,722,612 | A | 3/1998 | Feathers | |
| 5,762,282 | A | 6/1998 | Wolner | |
| 5,878,855 | A | 3/1999 | Miyata | |
| 5,927,438 | A | 7/1999 | Ostrobrod | |
| 6,019,304 | A | 2/2000 | Skowronski et al. | |
| 6,085,368 | A | 7/2000 | Robert et al. | |
| 6,182,791 | B1 | 2/2001 | Cope | |
| 6,283,398 | B1 | 9/2001 | Specht | |
| 6,494,292 | B2 | 12/2002 | Cope | |
| 6,523,771 | B2 | 2/2003 | Sumiyashiki | |
| 6,550,597 | B2 | 4/2003 | Taniguchi | |
| 6,810,997 | B2 | 11/2004 | Schreiber et al. | |
| 7,258,324 | B2 | 8/2007 | Gilman | |
| 7,281,620 | B2 | 10/2007 | Wolner et al. | |
| 7,946,387 | B2 * | 5/2011 | Betcher et al. | 182/231 |
| 2002/0179372 | A1 | 12/2002 | Schreiber et al. | |
| 2004/0065508 | A1 | 4/2004 | Avots et al. | |
| 2005/0039981 | A1 | 2/2005 | Wooster et al. | |
| 2005/0051659 | A1 | 3/2005 | Wolner et al. | |
| 2006/0113147 | A1 | 6/2006 | Harris, Jr. | |
| 2007/0215410 | A1 | 9/2007 | Ecker | |
| 2007/0261921 | A1 | 11/2007 | Gal et al. | |
| 2008/0035423 | A1 | 2/2008 | Meillet et al. | |
| 2008/0128221 | A1 | 6/2008 | Rogge | |
| 2009/0084883 | A1 | 4/2009 | Casebolt et al. | |
| 2010/0224448 | A1 | 9/2010 | Wolner et al. | |
| 2010/0226748 | A1 | 9/2010 | Wolner et al. | |

FOREIGN PATENT DOCUMENTS

| | | | |
|---|---|---|---|
| DE | 29 19 216 | A1 | 11/1980 |
| DE | 198 18 688 | C1 | 1/2000 |
| DE | 201 08 777 | U1 | 8/2001 |
| DE | 203 06 119 | U1 | 6/2003 |
| DE | 102 10 969 | A1 | 10/2003 |
| DE | 20 2006 020 127 | U1 | 11/2007 |
| DE | 20 2007 013 135 | U1 | 4/2008 |
| EP | 0 247 818 | A2 | 12/1987 |
| FR | 1208895 | A | 2/1960 |
| FR | 2654940 | A1 | 5/1991 |
| GB | 238302 | | 8/1925 |
| GB | 999553 | A | 7/1965 |
| GB | 2 256 413 | A | 12/1992 |
| GB | 2 279 636 | A | 1/1995 |
| GB | 2 306 107 | A | 4/1997 |
| WO | WO 97/12786 | | 4/1997 |
| WO | WO 2006/094486 | A1 | 9/2006 |
| WO | WO 2008/008225 | A2 | 1/2008 |
| WO | WO2009/047470 | A1 | 4/2009 |

OTHER PUBLICATIONS

"APTURA™ LT30 Self-Retracting Lanyard", http://msafallprotection.com/product16592.html, MSA The Safety Company, 2 pages (Known of prior to filing of U.S. Appl. No. 12/751,386. Printed Sep. 17, 2010) (© MSA 2010).

"APTURA™ LT30 Self-Retracting Lanyard [Advanced Performance Technology]", ID 2300-69/Apr. 2004, MSA (FP), 4 pages (© MSA 2004).

"Instructions for Field Line Replacement on the APTURA™ LT12 SRL", Bulletin 2301-30, MSA (FP), 1 page. (© MSA 2003).

"APTURA™ LT30 Self-Retracting Lanyard (SRL) Features & Benefits", 2301-54, MSA (FP), 1 page (© MSA 2004).

"ANSI Z359-Compliant Products from MSA", ID 2302-29-MC/Dec. 2008, MSA The Safety Company, 12 pages (© MSA 2008).

"APTURA™ LT12 Self Retracting Lanyard User Instructions for Field Line Replacement", P/N 10044813, MSA (FP), 8 pages (© 2003 MSA).

"APTURA™ LT12 Self Retracting Lanyard [Advanced Performance Technology]", ID 2300-51, Rev. A/Feb. 2003, MSA (FP), 4 pages (© 2003 MSA).

Photographs of fall arrest block device, International Safety Components Ltd., Bangor, Gwynedd, United Kingdom, 11 pages (known of prior to filing of U.S. Appl. No. 12/400,208).

"Retrieval Instructions—To Engage and Disengage the Function Winch—Retractable Type Fall Arrester—AD515, EN360-EN1496 Classe B", Protecta® International, Carros, Cedex, France, 4 pages (known of prior to filing of U.S. Appl. No. 12/400,208).

User Instruction Manual Rollgliss® Rescue Emergency Descent Device with Manual Retract, High-Speed, DBI/SALA®, Form 5902152 Rev: A, 12 pages (© 2000 DB Industries, Inc.).

"User Instruction Manual Fisk Descender", DBI SALA®, Form 5902142 Rev: D, 36 pages (© 2002 DB Industries, Inc.).

Fiche technique, Tractel Group, 3 pages (© TRACTEL S.A.S. 2003).

User Instruction Manual for Rescue/Personnel Riding System Rollgliss R350, DBI/SALA®, Form 5902125 Rev: A, 28 pages (© 2004, DB Industries, Inc.).

"User Instruction Manual—Sealed Self Retracting Lifelines", DBI/SALA®, Form 5902122 Rev: G, 26 pages (© 2004—DB Industries, Inc.).

Protecta, Instructions for Use AD Series Self Retracting Lifelines, Form 5902290 Rev: F, 2 pages (© Protecta 2005).

"User Instruction Manual Rescumatic® Emergency Escape Device and Rescue Cradle", DBI SALA®, Form 5906277 Rev: F, 16 pages (©2005, DB Industries, Inc.).

FALLSTOP® Safety, BORNACK, pp. 55-64 (© Bornack 2007).

"Sealed Self Retracting Lifeline—Revolutionary Sealed Design Stands-Up to Even the Harshest Environments for Ultimate Safety and Reliability!", DBI/SALA®, 2 pages (© 2007—Capital Safety).

"User Instructions Manual Self Retracting Lifelines", DBI SALA®, 38 pages Form: 5902101C Rev: I (© 2007, DB Industries, Inc.).

Fall Arrest Block UB157, ISC (International Safety Components Ltd.), Bangor, Gwynedd, United Kingdom, 4 pages (Printed Sep. 14, 2007).

User Instruction Manual Rollgliss® Rescue Emergency Descent Device with Auto-Retract, DBI SALA®, Form No. 5902105 Rev. B, 16 pages (©2008, DB Industries, Inc.).

International Search Report for PCT/US2010/054186 mailed Mar. 3, 2011.

* cited by examiner

BRAKE ASSEMBLY FOR A SELF-RETRACTING LIFELINE ASSEMBLY

CROSS-REFERENCE TO RELATED APPLICATIONS

This Application claims priority to U.S. Provisional Application Ser. No. 61/257,228, same title herewith, filed on Nov. 2, 2009 which is incorporated in its entirety herein by reference.

BACKGROUND

Self-retracting lifelines are well known in the art of fall protection safety equipment for use by workers performing tasks during which a risk of a fall may occur. Self-retracting lifelines generally include a housing containing a drum around which a cable, rope, or webbing is wound. The drum is spring biased to payout cable as tension pulling the cable is applied and to retract any of the cable that has been unwound from the drum as the tension on the cable is reduced or released. The housing also includes a brake assembly for stopping rotation of the drum when the cable suddenly unwinds from the drum at a rate greater than a predetermined maximum angular velocity.

A self-retracting lifeline is typically connected to a support structure within the vicinity of where the worker is performing a task. An end of the cable is typically connected to a safety harness worn by the worker. The cable is easily drawn out of the self-retracting lifeline housing as the worker moves away from the device, and the cable is automatically drawn back into the housing as the worker moves toward the device. Should a fall occur, the brake assembly within the device is automatically engaged by a centrifugal clutch assembly, which gradually and quickly stops the worker's fall by gradually and quickly stopping the rotation of the drum. As the rotation of the drum is stopped, additional cable is prevented from being paid out of the housing to stop the fall of the worker.

For the reasons stated above and for other reasons stated below which will become apparent to those skilled in the art upon reading and understanding the present specification, there is a need in the art for an improved braking mechanism for a self-retracting lifeline assembly.

SUMMARY OF INVENTION

The above-mentioned problems of current systems are addressed by embodiments of the present invention and will be understood by reading and studying the following specification. The following summaries are made by way of examples and not by way of limitation. They are merely provided to aid the reader in understanding some of the aspects of the invention.

In one embodiment, a braking system for a self-retracting lifeline assembly is provided. The braking system includes at least a housing, a ratchet cam and a clutch assembly. The housing includes sidewalls that form, at least in part, a cavity. The sidewalls of the housing terminate in a connecting surface that extends around the cavity. The sidewalls have a plurality of notches spaced along interior surfaces of the sidewalls. Each notch extends from the connecting surface a select distance in the interior surfaces of the sidewalls of the housing. The ratchet cam includes an inner edge that defines a central cam opening. The inner edge of the ratchet cam has a plurality of inward extending teeth. The ratchet cam further has an outer edge. The outer edge has a plurality of outward extending fingers. Each finger terminates in a finger tip. Each finger tip is received in an associated notch in the interior surface of the housing. The clutch assembly is operationally configured to engage at least one tooth of the plurality of inward extending teeth of the ratchet cam in response to a lifeline unwinding from the assembly at a rate greater than a predetermined maximum angular velocity.

In another embodiment a self-retracting lifeline assembly is provided. The self-retracting lifeline assembly includes a housing, a ratchet cam and a clutch. The housing includes sidewalls that form at least in part a cavity. The sidewalls of the housing terminate in a connecting surface that extends around the cavity. The sidewalls having a plurality of notches spaced along interior surfaces of the sidewalls. Each notch extends from the connecting surface a select distance in the interior surfaces of the sidewalls of the housing. The ratchet cam has a central cam opening. The ratchet cam includes an inner edge that defines the central cam opening. The inner edge of the ratchet cam has a plurality of inward extending teeth. The ratchet cam further has an outer edge. The outer edge has a plurality of outward extending fingers. Each finger terminates in a finger tip. Each finger tip is received in an associated notch in the interior surface of the housing. The clutch assembly is operationally configured to engage at least one tooth of the plurality of inward extending teeth of the ratchet cam in response to a lifeline unwinding from the assembly at a rate greater than a predetermined maximum angular velocity.

In further another embodiment, another self-retracting lifeline assembly is provided. The self-retracting lifeline assembly includes a housing having sidewalls, an interior plate, a shaft and a ratchet cam. The interior plate is received in the housing. The interior plate and interior surfaces of the sidewalls of the housing form a clutch cavity. The sidewalls of the housing terminate in a connecting surface that extends around the clutch cavity. The sidewalls have a plurality of notches spaced along the interior surface of the sidewalls. Each notch extends from the connecting surface a select distance in the interior surfaces of the sidewalls of the housing. The shaft is received in the housing. The shaft is operationally coupled to a lifeline. The shaft further has an end that extends through the central opening in the interior plate into the clutch cavity. The clutch assembly is received in the clutch cavity and is operationally coupled to the shaft proximate the interior plate. The ratchet cam has a central cam opening. The ratchet cam also includes an inner edge that defines the central cam opening. The inner edge of the ratchet cam has a plurality of inward extending teeth. The clutch assembly is configured to engage at least one tooth of the plurality of teeth in response to the shaft rotating beyond a select maximum angular velocity. The ratchet cam further has an outer edge. The outer edge has a plurality of outward extending fingers. Each finger terminates in a finger tip. Each finger tip is received in an associated notch in the interior surface of the sidewalls of the housing.

BRIEF DESCRIPTION OF THE DRAWINGS

The present invention can be more easily understood and further advantages and uses thereof more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical and mechanical changes may be made without departing from the spirit and scope of the present invention. The following detailed description is, therefore, not to be taken in a limiting sense, and the scope of the present invention is defined only by the claims and equivalents thereof.

Figures 1, 3:
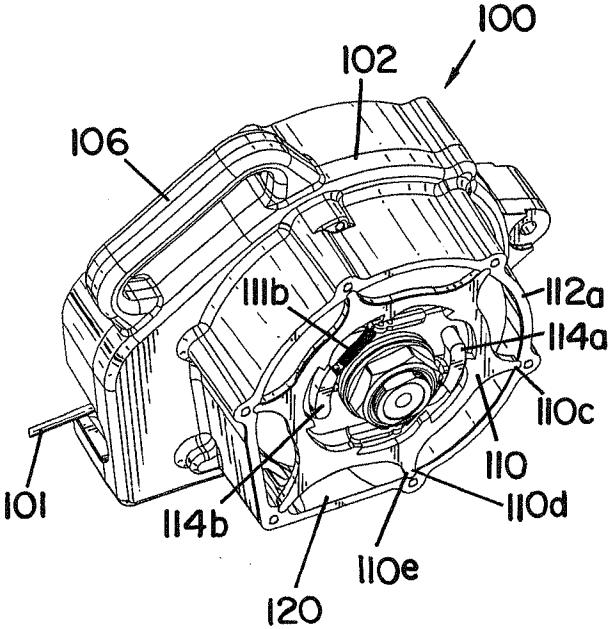
FIG. 1 is a side perspective view of a self-retracting lifeline assembly of one embodiment of the present invention.
FIG. 3 is a side perspective view of the self-retracting lifeline assembly of FIG. 1 having its cover and seal removed.
Figure 2:
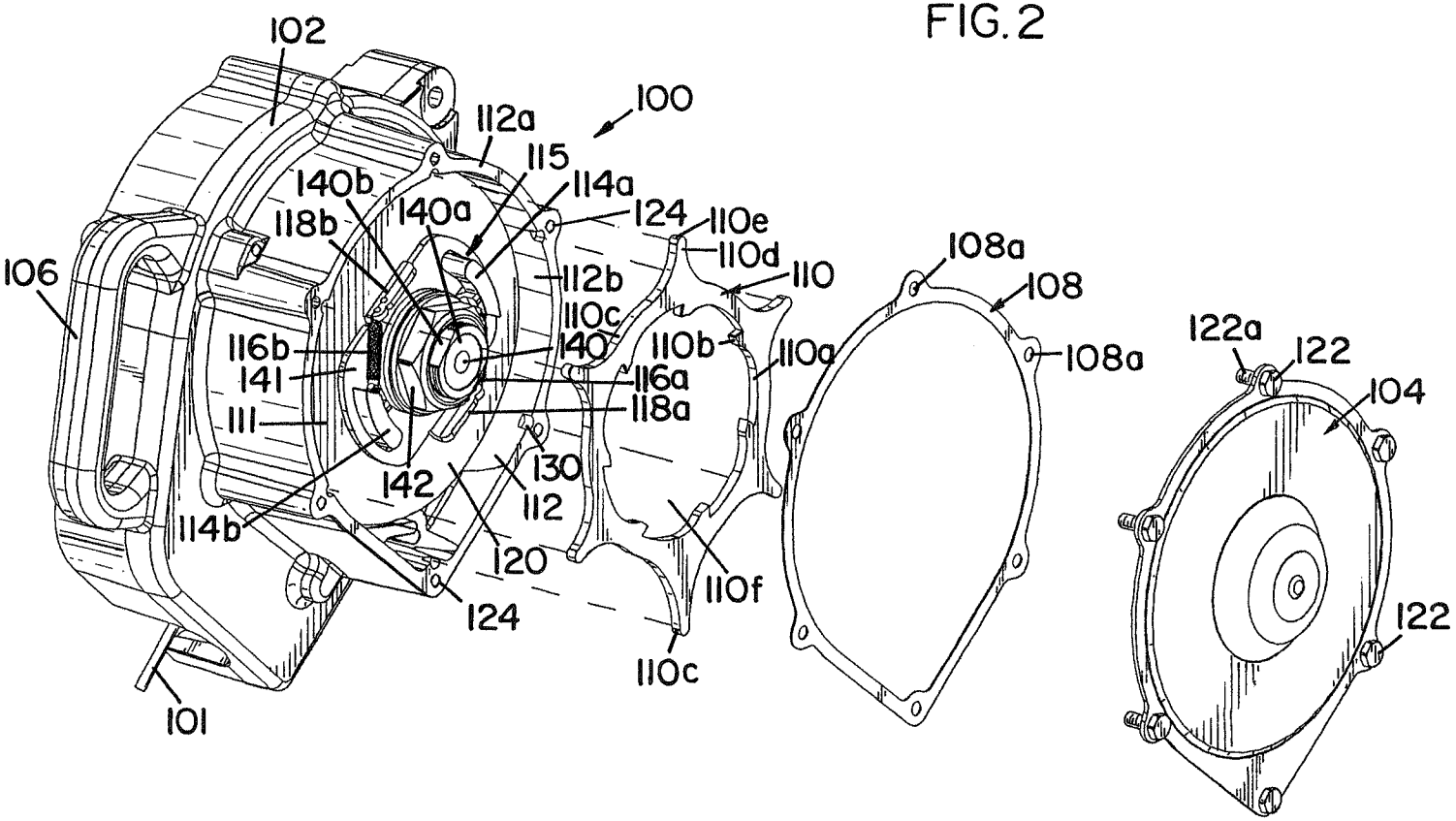
FIG. 2 is a side perspective view of a partially exploded self-retracting lifeline assembly of FIG. 1.

Embodiments of the present invention provide a braking system for a self-retracting lifeline assembly that includes a ratchet cam that is coupled to a housing of the assembly without specific fasteners. This design saves cost as well as facilitates replacement and assembly. The design also reduces the weight of the assembly because it eliminates fasteners and the need of additional material that would surround these fasteners. Referring to FIG. 1, a side perspective view of a self-retracting lifeline assembly 100 is illustrated. As illustrated, the assembly 100 includes a housing 102. A handle 106 extends from the housing 102 to aid in transporting the assembly 100. The assembly 100 also includes a cover 104 and a lifeline 101 that is received in the housing 102. The lifeline is operationally coupled to a payout/retracting system (not shown) in the housing which could be any suitable system. In FIG. 2, a side perspective view of a partially exploded self-retracting lifeline assembly is illustrated. As illustrated, the housing 102 has sidewalls 112. An interior plate 111 is received in the housing 102. The interior plate 111 and interior surfaces 112B of the sidewalls 112 of the housing 102 form a clutch cavity 120. The sidewalls 112 of the housing 102 terminate in a connecting surface 112*a* that extends around cavity 120. The sidewalls 112 include a plurality of notches 130 that are spaced along the interior surface 112*b* of the sidewalls 112. Each notch 130 extends from the connecting surface 112 a select distance in the interior surface 112*b* of the sidewalls of the housing 102. A shaft 140 is received in the housing. The shaft is operationally coupled to the payout/retracting system of the lifeline 101. The shaft 140 further has an end 140*a* that extends through a central opening (not shown) in the interior plate 111 into the clutch cavity 120.

A centrifugal clutch assembly 115 is received in the clutch cavity 120. The clutch assembly 115 is operationally coupled to the shaft 140 proximate the interior plate 111 via connecting nut 142. A ratchet cam 110 having a central cam opening 110*f* is further received in the cavity 120. The ratchet cam 110 includes an interior edge 110*a* that defines the central cam opening 110*f*. The interior edge 110*a* of the ratchet cam 110 has a plurality of inward extending teeth 110*b*. The clutch assembly 115 is configured to engage at least one tooth 110*b* of the plurality of teeth 110*b* in response to the shaft 140 rotating beyond a select maximum angular velocity. The ratchet cam 110 further has an outer edge 110*c*. The outer edge 110*c* has a plurality of outward extending fingers 110*d*. Each finger 110*d* terminates in a fingertip 110*e*. Each fingertip 110*e* is received in an associated notch 130 in the interior surface 112*b* of the sidewalls 112 of the housing 102. Although, the embodiment illustrated uses fingertips 110*e* of outward extending fingers 110*d* of the ratchet cam 110 to engage notches 130 in the housing, other types of configurations that prevent rotation/angular motion between the ratchet cam 110 and housing 102 can be used. For example, a square shaped ratchet cam sitting in a female square shaped housing could be used. Another example is a round ratchet cam with D cuts sitting in a housing with female D cuts. Hence, any type of outer geometry of the ratchet cam configured to engage inner surfaces of a housing that prevents rotation/angular motion between the two can be used.

The clutch assembly 115 includes a base plate 141 that is operationally coupled to shaft 140 in cavity 120. In one embodiment, the base plate 141 includes a central opening (not shown) that is shaped to lock the rotation of the base plate 141 with the rotation of the shaft 140. In particular, in one embodiment, this is done by conforming the shape of the central opening of the base plate 141 to the shape of the shaft 140 that includes at least one flat portion 140*b*. The clutch assembly 115 includes two pawls 114*a* and 114*b* that are pivotally coupled to the base plate 141. Each pawl 114*a* and 114*b* has an associated bracket 118*a* and 118*b* that is further coupled to the base plate 141*a* select distance from its associated pawl 114*a* and 114*b*. An associated biasing member 116*a* and 116*b* is coupled between an associate pawl 114*a* and 114*b* and associated bracket 118*a* and 118*b*. The associated biasing member 116*a* and 116*b* asserts a biasing force on its associated pawl 114*a* and 114*b* to retain its associated pawl 114*a* and 114*b* in a first pivot position when the angular velocity of the shaft 140 is less than a select maximum angular velocity. Each pawl 114*a* and 114*b* is further designed to counter the biasing force of its associated biasing member 116*a* and 116*b* to engage a tooth 110*b* of a ratchet cam 110 in second pivot position when the angular velocity of the shaft 140 is equal to or greater than the select maximum angular velocity.

In use, the retractable lifeline assembly 100 pays out and retracts the lifeline 101 as a worker performs his/her tasks. During this operational mode, the angular velocity of the shaft 140 is not fast enough to create enough of a centrifugal force to counter the biasing force of the biasing members 116*a* and 116*b*. Hence, during the operation mode the pawls 114*a* and 114*b* are retracted in the first position and the shaft 140 is free to rotate to payout and retract the lifeline 101. In a fall mode as the result of a fall event, the angular velocity of the shaft 140 creates a force that is greater than the biasing force of the biasing member 116*a* and 116*b*. This causes the paws 114*a* and 114*b* to rotate in relation to the base plate 141. Engaging ends of the paws 114*a* and 114*b* engage the inward extending teeth 110*b* of the ratchet cam 110 in the second position. Since the fingers tips 110*e* of the outward extending fingers 110*d* of the ratchet cam 110 are engaged in associate notches 130 in the housing 102, the shaft 140 is prevented from rotating 140 in relation to the housing 102 thereby preventing further payout of the lifeline 101 in the fall mode.

As further illustrated in FIG. 2, the self-retracting lifeline assembly 100 includes a cover 104 and a seal 108. The seal 108 is positioned between the cover 104 and the connecting surface 112*a*. The cover 104 is coupled to the connecting surface 112*a* of the housing 102 to cover the clutch cavity 120 and retain the ratchet cam 110 within the housing 102. A plurality of fasteners 122 couple the cover 104 to the housing 102. In particular, in this embodiment, the cover 104 has a plurality of cover passages (not shown) proximate an outer perimeter of the cover 104. The seal 108 further has a plurality of seal passages 108*a* that align with the cover passages. The housing 102 has a plurality of threaded bores 124 formed through the connecting surface 112*a*. The threaded bores 124 align with the cover passages and seal passages 108*a*. The fasteners 122 have a threaded engaging section 122*a*. The fasteners pass through the cover passages, through the seal passages 108*a* and engage the threaded bores 130 in the housing 102 to couple the cover 108 to the housing 102.

Figure 4:
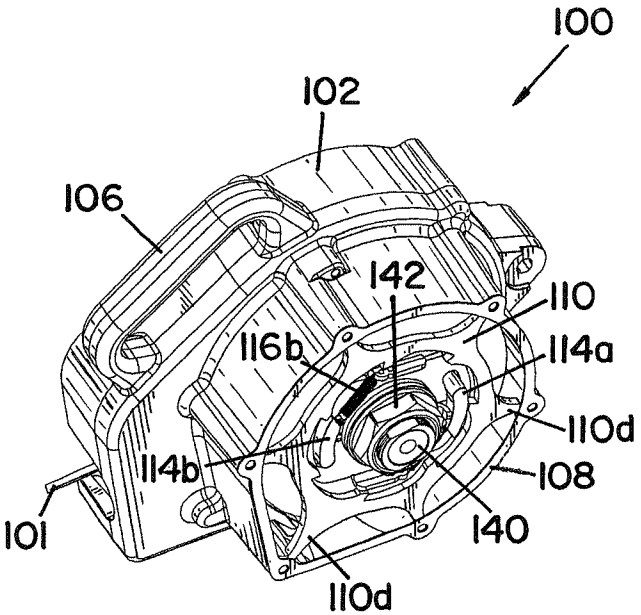
FIG. 4 is a side perspective view of the self-retracting lifeline assembly of FIG. 1 with its cover removed.
Figure 5B:
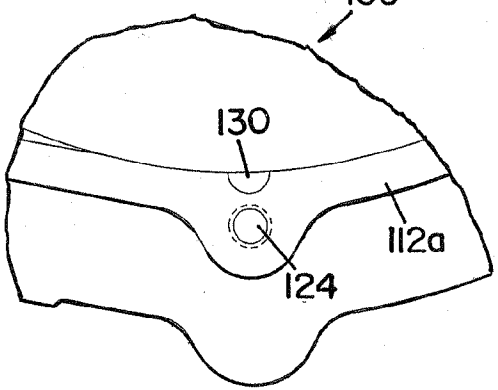
FIG. 5B is a close-up view of a connecting surface of the housing of the self-retracting lifeline assembly of FIG. 5A.
Figure 5A:
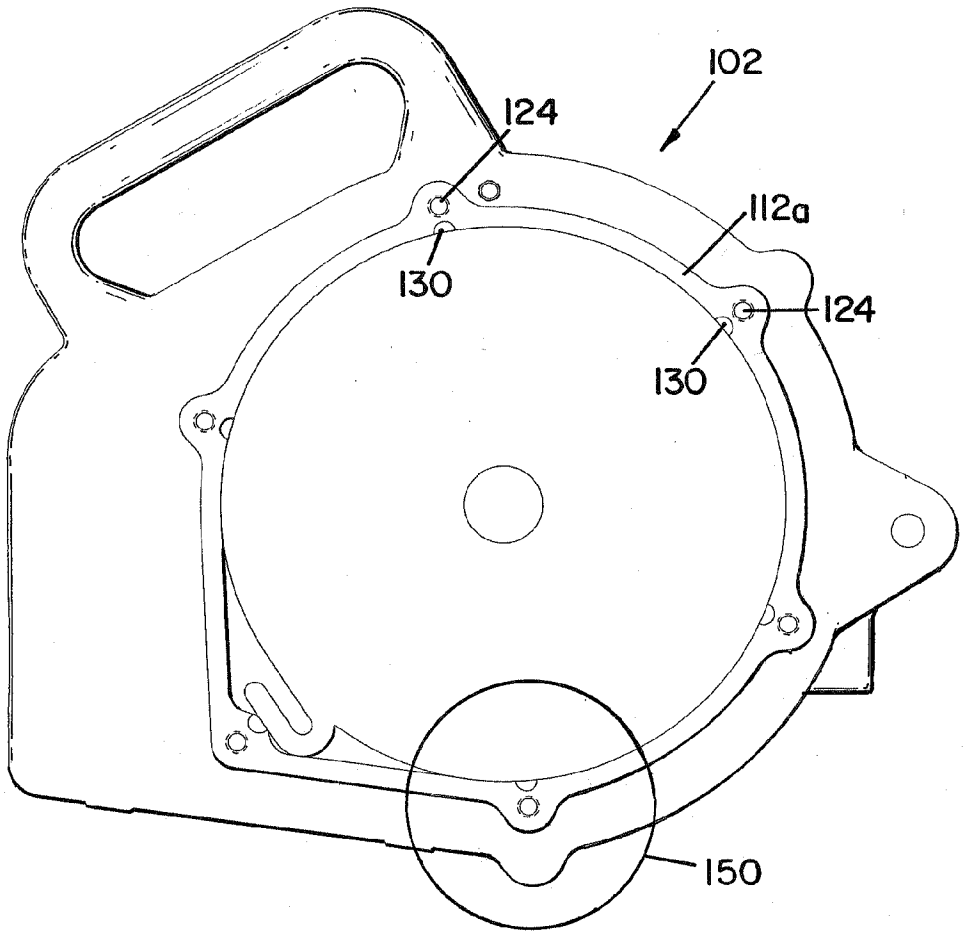
FIG. 5A is a side view of a housing of the self-retracting lifeline assembly of FIG. 1 illustrating notches in the inner surface.
Figure 6:
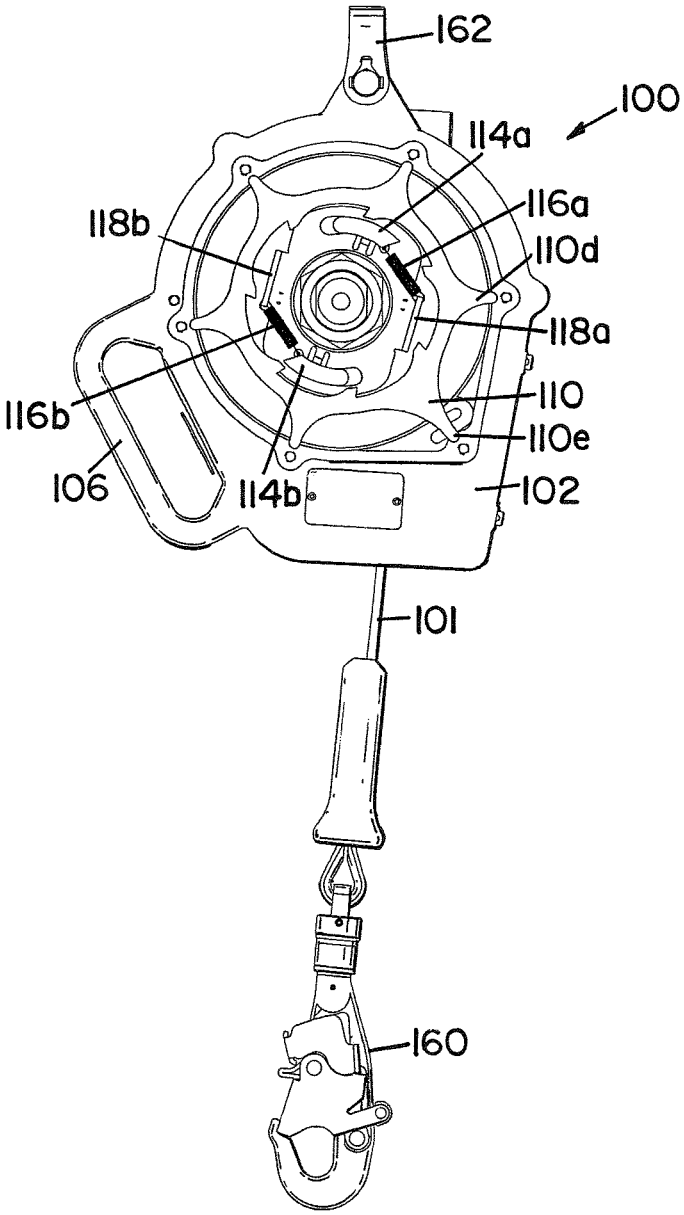
FIG. 6 is a side view of the self-retracting lifeline assembly without a cover of one embodiment of the present invention of FIG. 1.

Referring to FIG. 3, a side perspective view of the self-retracting lifeline assembly 100 without a seal and cover is illustrated. This illustration shows the ratchet cam 110 received in the cavity 120. In particular, this illustration shows the tips 110*e* of the fingers 110*d* of the ratchet cam 110 received in the notches 130 of the housing 102. Hence, no fasteners are needed to keep the ratchet cam 110 in a static position in relation to the housing 102. FIG. 4 illustrates another side perspective view of the self-retracting lifeline assembly 100 without a cover. In this view, seal 108 has been positioned over the connecting surface 112*a* of the housing 102. Hence, the seal 108 and the cover retain the ratchet cam 110 within the cavity 120 of the housing 102. The seal 108 when coupled to the housing 102 via the cover 104 exerts pressure on the finger tips 110*e* of the ratchet cam 110 to securely retain the ratchet cam 110 within the housing 102. Referring to FIG. 5A a side view of the self-retracting lifeline assembly 100 is illustrated. FIG. 5A further illustrates connecting surface 112*a* including notches 130 and threaded bores 124. FIG. 5B shows close-up section 150 of FIG. 5A. In particular, FIG. 5B illustrates connecting surface 112*a* and the positioning of a notch 130 in relation to a threaded bore 124 in this embodiment. Finally, FIG. 6 illustrates a side view of a self-retracting lifeline assembly 100 without a cover and seal. This embodiment illustrates a connecting member 162 that is coupled to the housing 102. The connecting member 162 is used to connect the self-retracting lifeline assembly 100 to a support structure (not shown). FIG. 6 also illustrates that lifeline 106 is coupled to a snap hook 160. The snap hook 160 in turn would be coupled to a safety harness (not shown) of a user.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A braking system for a self-retracting lifeline comprising:

a housing having an interior surface that forms a cavity;

a centrifugal clutch assembly operationally coupled to rotate in response to a movement of a lifeline, the centrifugal clutch assembly including at least one pawl, the at least one pawl configured to pivot outward in response to an angular velocity greater than a select maximum angular velocity caused by the movement of the lifeline, the centrifugal clutch assembly received within the cavity in the housing;

a ratchet cam having a central cam opening received within the cavity of the housing, the ratchet cam including an inner edge that defines the central cam opening, the inner edge of the ratchet cam having a plurality of inward extending teeth, the at least one pawl of the centrifugal clutch assembly configured to engage a tooth of the plurality of teeth when the at least one pawl pivots outward in response to the select centrifugal forces, the ratchet cam further having an outer edge that is opposably positioned in relation to the inner edge, the outer edge having a select geometry, at least a portion of the outer edge engaging the interior surface of the housing thereby preventing angular motion of the ratchet cam in relation to the housing, wherein the engagement of the at least one pawl with a tooth of the plurality of inward extending teeth of the ratchet cam prevents further movement of the lifeline.

2. The braking system for a self-retracting lifeline of claim 1, wherein the select geometry of the outer edge of the ratchet cam includes a plurality of outward extending fingers, each finger terminating in a finger tip, each finger tip received in an associated notch in the interior surface of the housing.

3. The braking system for a self-retracting lifeline of claim 2, further comprising:

the housing including sidewalls;

an interior plate received in the housing, the interior plate and interior surfaces of the sidewalls of the housing forming a clutch cavity, the sidewalls of the housing terminating in a connecting surface that extends around the clutch cavity, the sidewalls having a plurality of notches spaced along the interior surface of the sidewalls, each notch extending from the connecting surface a select distance in the interior surfaces of the sidewalls of the housing; and a shaft received in the housing, the shaft operationally coupled to a lifeline, the shaft further having an end that extends through a central opening in the interior plate into the clutch cavity, the centrifugal clutch operationally coupled to the shaft.

4. The braking system for a self-retracting lifeline of claim 3, wherein the clutch assembly further includes:

a base plate operationally coupled to the shaft;

at least one bracket coupled to the base plate;

the at least one pawl pivotally coupled to the base plate; and at least one biasing member coupled between the at least one pawl and the at least one bracket to assert a biasing force on the at least one pawl to retain the at least one pawl in a first pivot position when the angular velocity of the shaft is less than a select maximum angular velocity, the at least one pawl configured to counter the biasing force of the biasing member to engage a tooth of the ratchet cam in a second pivot position when the angular velocity of the shaft is greater than the select maximum angular velocity.

5. The braking system for a self-retracting lifeline of claim 3, further comprising:

a cover configured to be coupled to the connecting surface of the housing to cover the clutch cavity and retain the ratchet cam within the housing.

6. The braking system for a self-retracting lifeline of claim 5, further comprising:

a seal positioned between the cover and the connecting surface.

7. The braking system for a self-retracting lifeline of claim 6, further comprising:

a plurality of fasteners configured to couple the cover to the housing.

8. The braking system for a self-retracting lifeline of claim 7, wherein the cover has a plurality of cover passages proximate an outer perimeter of the cover, the seal further having a plurality of seal passages aligned with the cover passages, the housing further having a plurality of threaded bores formed through the connecting surface, the threaded bores aligned with the cover passages and the seal passages, the fasteners having a threaded engaging section, the fasteners passing through the cover passages, the seal passages and engaging the treaded bores in the housing to couple the cover to the housing.

9. A self-retracting lifeline assembly comprising:

a housing including sidewalls that form at least in part a cavity, the sidewalls of the housing terminating in a connecting surface that extends around the cavity, the sidewalls having a plurality of notches spaced along interior surfaces of the sidewalls, each notch extending from the connecting surface a select distance in the interior surfaces of the sidewalls of the housing;

a ratchet cam received within the cavity of the housing having a central cam opening, the ratchet cam including an inner edge that defines the central cam opening, the inner edge of the ratchet cam having a plurality of inward extending teeth, the ratchet cam further having an outer edge, the outer edge having a plurality of outward extending fingers, each finger terminating in a finger tip, each finger tip received in an associated notch in the interior surface of the housing; and a clutch assembly operationally configured to engage at least one tooth of the plurality of inward extending teeth of the ratchet cam in response to a lifeline unwinding from the assembly at a rate greater than a predetermined maximum angular velocity.

10. The self-retracting lifeline assembly of claim 9, wherein the clutch assembly further comprises:

at least one pawl configured to engage the tooth of the plurality of teeth when the at least one pawl pivots outward in response to select centrifugal forces caused by the lifeline unwinding from the assembly at a rate greater than a predetermined maximum angular velocity.

11. The self-retracting lifeline assembly of claim 9, further comprising:

a shaft received in the housing, the shaft operationally coupled to the lifeline, the shaft further having an end that extends through the central opening in an interior plate into the cavity, the clutch assembly operationally coupled to the shaft.

12. The self-retracting lifeline assembly of claim 11, wherein the clutch assembly further includes:

a base plate operationally coupled to the shaft;

at least one bracket coupled to the base plate;

the at least one pawl pivotally coupled to the base plate; and at least one biasing member coupled between the at least one pawl and the at least one bracket to assert a biasing force on the at least one pawl to retain the at least one pawl in a first pivot position when the angular velocity of the shaft is less than the select maximum angular velocity, the at least one pawl configured to counter the biasing force of the biasing member to engage a tooth of the ratchet cam in a second pivot position when the angular velocity of the shaft is greater than the select maximum angular velocity.

13. The self-retracting lifeline assembly of claim 9, further comprising:

a cover configured to be coupled to the connecting surface of the housing to cover the clutch cavity and retain the ratchet cam within the housing; and a seal positioned between the cover and the connecting surface.

14. A self-retracting lifeline assembly comprising:

a housing including sidewalls;

an interior plate received in the housing, the interior plate and interior surfaces of the sidewalls of the housing forming a clutch cavity, the sidewalls of the housing terminating in a connecting surface that extends around the clutch cavity, the sidewalls having a plurality of notches spaced along the interior surface of the sidewalls, each notch extending from the connecting surface a select distance in the interior surfaces of the sidewalls of the housing;

a shaft received in the housing, the shaft operationally coupled to a lifeline, the shaft further having an end that extends through the central opening in the interior plate into the clutch cavity;

a clutch assembly received in the clutch cavity, the clutch assembly operationally coupled to the shaft proximate the interior plate; and a ratchet cam received within the clutch cavity having a central cam opening, the ratchet cam includes an inner edge that defines the central cam opening, the inner edge of the ratchet cam having a plurality of inward extending teeth, the clutch assembly configured to engage at least one tooth of the plurality of teeth in response to the shaft rotating beyond a select maximum angular velocity, the ratchet cam further having an outer edge, the outer edge having a plurality of outward extending fingers, each finger terminating in a finger tip, each finger tip received in an associated notch in the interior surface of the sidewalls of the housing.

15. The self-retracting lifeline assembly of claim 14, further comprising:

a cover configured to be coupled to the connecting surface of the housing to cover the clutch cavity and retain the ratchet cam within the housing.

16. The self-retracting lifeline assembly of claim 15, further comprising:

a seal positioned between the cover and the connecting surface.

17. The self-retracting lifeline assembly of claim 16, further comprising:

a plurality of fasteners configured to couple the cover to the housing.

18. The self-retracting lifeline assembly of claim 17, wherein the cover has a plurality of cover passages proximate an outer perimeter of the cover, the seal further having a plurality of seal passages aligned with the cover passages, the housing further having a plurality of threaded bores formed through the connecting surface, the threaded bores aligned with the cover passages and the seal passages, the fasteners having a threaded engaging section, the fasteners passing through the cover passages, the seal passages and engaging the threaded bores in the housing to couple the cover to the housing.

19. The self-retracting lifeline assembly of claim 14, further comprising:

a handle coupled to the housing for ease in transporting the assembly.

20. The self-retracting lifeline assembly of claim 14, further comprising:

a connecting member configured to couple the assembly to a support; and a snap hook coupled to the lifeline, the snap hook configured to be coupled to a safety harness.

21. The self-retracting lifeline assembly of claim 14, wherein the clutch assembly further includes:

a base plate operationally coupled to the end of the shaft;

at least one bracket coupled to the base plate;

at least one pawl pivotally coupled to the base plate;

at least one biasing member coupled between the at least one pawl and the at least one bracket to assert a biasing force on the at least one pawl to retain the at least one pawl in a first pivot position when the angular velocity of the shaft is less than a select maximum angular velocity, the at least one pawl configured to counter the biasing force of the biasing member to engage a tooth of the ratchet cam in a second pivot position when the angular velocity of the shaft is greater than the select maximum angular velocity.

* * * * *

UNITED STATES PATENT AND TRADEMARK OFFICE

CERTIFICATE OF CORRECTION

PATENT NO. : 8,567,562 B2
APPLICATION NO. : 12/902425
DATED : October 29, 2013
INVENTOR(S) : Vincent G. Meillet and Joseph R. Kaiser It is certified that error appears in the above-identified patent and that said Letters Patent is hereby corrected as shown below:

On the Title Page

(73) Assignee:, delete "B D Industries, LLC" and insert --D B Industries, LLC-- therefor.

Signed and Sealed this
Tenth Day of October, 2017

Joseph Matal

Joseph Matal
*Performing the Functions and Duties of the*
*Under Secretary of Commerce for Intellectual Property and*
*Director of the United States Patent and Trademark Office*